US005445499A

United States Patent [19]

Charbonnel

[11] Patent Number: 5,445,499

[45] Date of Patent: Aug. 29, 1995

[54] RETAINING AND SEALING SYSTEM FOR ROTOR BLADES

[75] Inventor: Jean-Louis Charbonnel, Boissise le Roi, France

[73] Assignee: Societe Nationale D'Etude et de Construction de Moteurs D'Aviation "Snecma", Paris, France

[21] Appl. No.: 181,104

[22] Filed: Jan. 13, 1994

[30] Foreign Application Priority Data

Jan. 27, 1993 [FR] France ..... 93 00768

[51] Int. Cl.[6] ..... F01D 5/32

[52] U.S. Cl. ..... 416/220 WR; 416/221

[58] Field of Search ..... 416/220 R, 221

[56] References Cited

U.S. PATENT DOCUMENTS

| | | | |
|---|---|---|---|
| 3,397,865 | 8/1968 | Catlow et al. | 416/221 |
| 4,432,555 | 2/1984 | Langley | 416/220 R |
| 4,470,757 | 9/1984 | Vollinger | 416/220 R |
| 4,854,821 | 8/1989 | Kernon et al | 416/220 R |
| 5,330,324 | 7/1994 | Agram et al. | 416/220 R |

FOREIGN PATENT DOCUMENTS

| | | | |
|---|---|---|---|
| 1319587 | 1/1963 | France . | |
| 1491480 | 11/1977 | United Kingdom | 416/220 R |
| 2095763 | 10/1982 | United Kingdom . | |

*Primary Examiner*—Edward K. Look
*Assistant Examiner*—James A. Larson
*Attorney, Agent, or Firm*—Oblon, Spivak, McClelland, Maier & Neustadt

[57] ABSTRACT

A system for retaining and sealing vanes and composed of an flange provided with a throat on tabs which are interlaced in other tabs, also provided with throats of the vane feet. An elastic joint is engaged in the throats and a disk throat and keeps the elements of the flange and the vanes in an axial position.

5 Claims, 6 Drawing Sheets

RETAINING AND SEALING SYSTEM FOR ROTOR BLADES

FIELD OF THE INVENTION

The invention concerns a system for retaining and sealing vanes engaged in the axial broachings of a rotor disk.

BACKGROUND OF THE INVENTION

Certain turbo-engines have a rotor formed of a disk and vanes provided with feet intended to be engaged in axial or slightly oblique broachings established at the periphery of the disk. It is then vital to provide means to stop the feet from sliding to a position which would obstruct the clearances existing between the feet and the surfaces of the broachings which could constitute by-pass passages for the gases which circulate in the turbo-engine, thus resulting in adversely affecting the efficiency of the latter. Therefore, sets of joints or flanges of varied designs have been provided, one example being described in the U.S. Pat. No. 4,846,628. The joints and the flanges are retained against any axial movement by means of grooves or small tongues situated on the vanes and the disk. They also need to be retained against a radial extension movement which the centrifugal forces tend to produce. The result of these stresses of the joints and flanges cause them to assume a relatively complicated shape which makes it frequently delicate to place the latter, especially if they need to be deformed.

SUMMARY OF THE INVENTION

The main object of the invention is to ensure that the vanes are retained in a simple manner while ensuring good imperviousness.

The system used includes a circular sealing flange for vanes having feet slidably engaged in the axial broachings of a rotor disk; the flange is circular and mounted on the disk and in front of one extremity face of the broachings so as to cover the vane feet; it includes an internal sealing lip housed in a circular recess of the disk and one external sealing lip applied on a bearing surface of the vane feet. The system is characterized in that the flange and the vane feet have tabs mutually imbricated and provided with a first throat radially open towards the inside; the disk has a second throat radially open towards the outside and situated in front of the first throat; an elastic joint occupies at least the first throat while being able to be fully driven back into the second throat; in addition, the flange is divided into sectors of a circle, each sector being provided with a projection touching a disk projection via its radially external face, one of the sectors having a smaller width and able to be installed by means of a radial and longitudinal movement between the other sectors; finally, each sector bears one of the tabs and the tabs of the sectors have an angular extension smaller than the spacings between the projections of the disk.

In one preferred embodiment which makes it possible to alternate the assembling of the vanes and sectors of the flange, the number of the sectors is the same as that of the vanes and the tabs of the sectors then alternate with those of the vane feet.

The projections of the sectors are advantageously merged with the tabs of the sectors.

The result of the above is that the sectors, apart from the one of smaller width which is dealt with in a particular way, are firstly placed via a radial movement which introduces their internal lip into the circular recess, thus making the projections and the tabs of the sectors move between the projections of the disk, then by a movement tangential to the disk which makes the projections of the sectors move under the projections of the disk, the outer lips onto the bearing surfaces of the vane feet and places the tabs of the sectors next to the tabs of the vane feet.

In addition, the flange may include a gasket on the outer lip which touches the bearing surface.

BRIEF DESCRIPTION OF THE DRAWINGS

There now follows a detailed description of the invention with reference to the accompanying figures given by way of non-restrictive illustration.

DETAILED DESCRIPTION OF THE PREFERRED EMBODIMENTS

Figure 1:
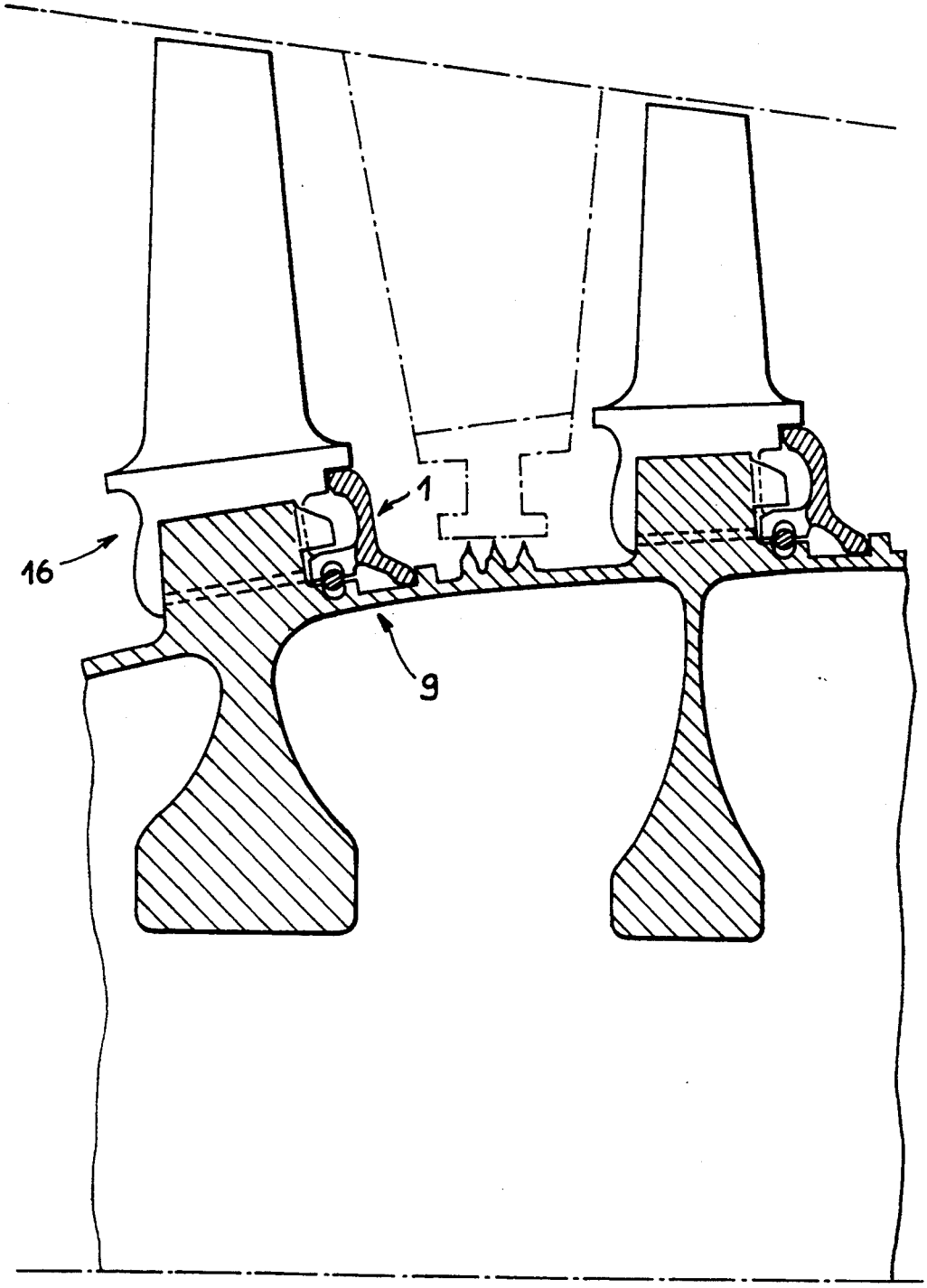
FIG. 1 generally represents a longitudinal section of the system.
Figure 2:
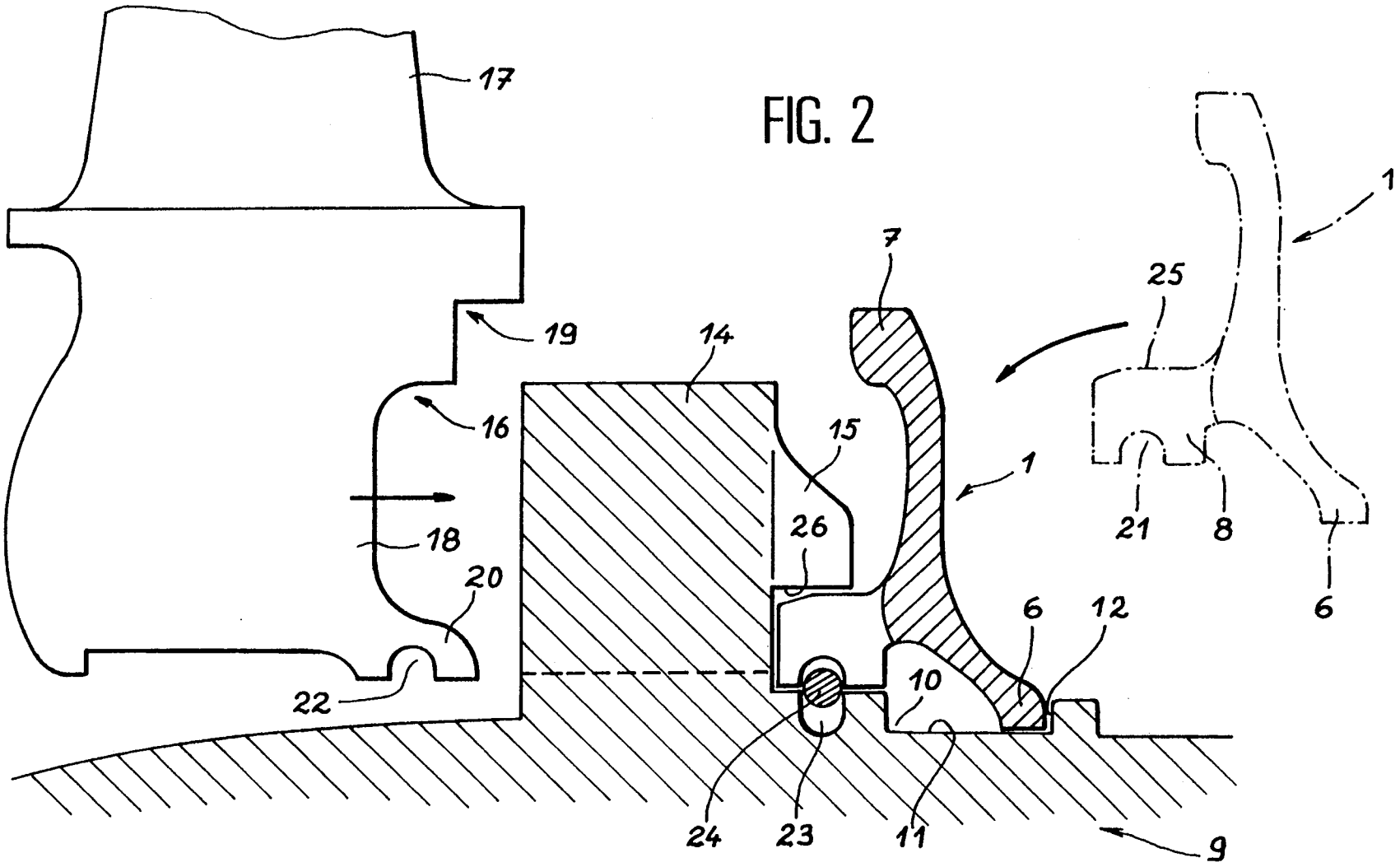
FIG. 2 shows the system in more detail with the vanes extracted.
Figure 3:
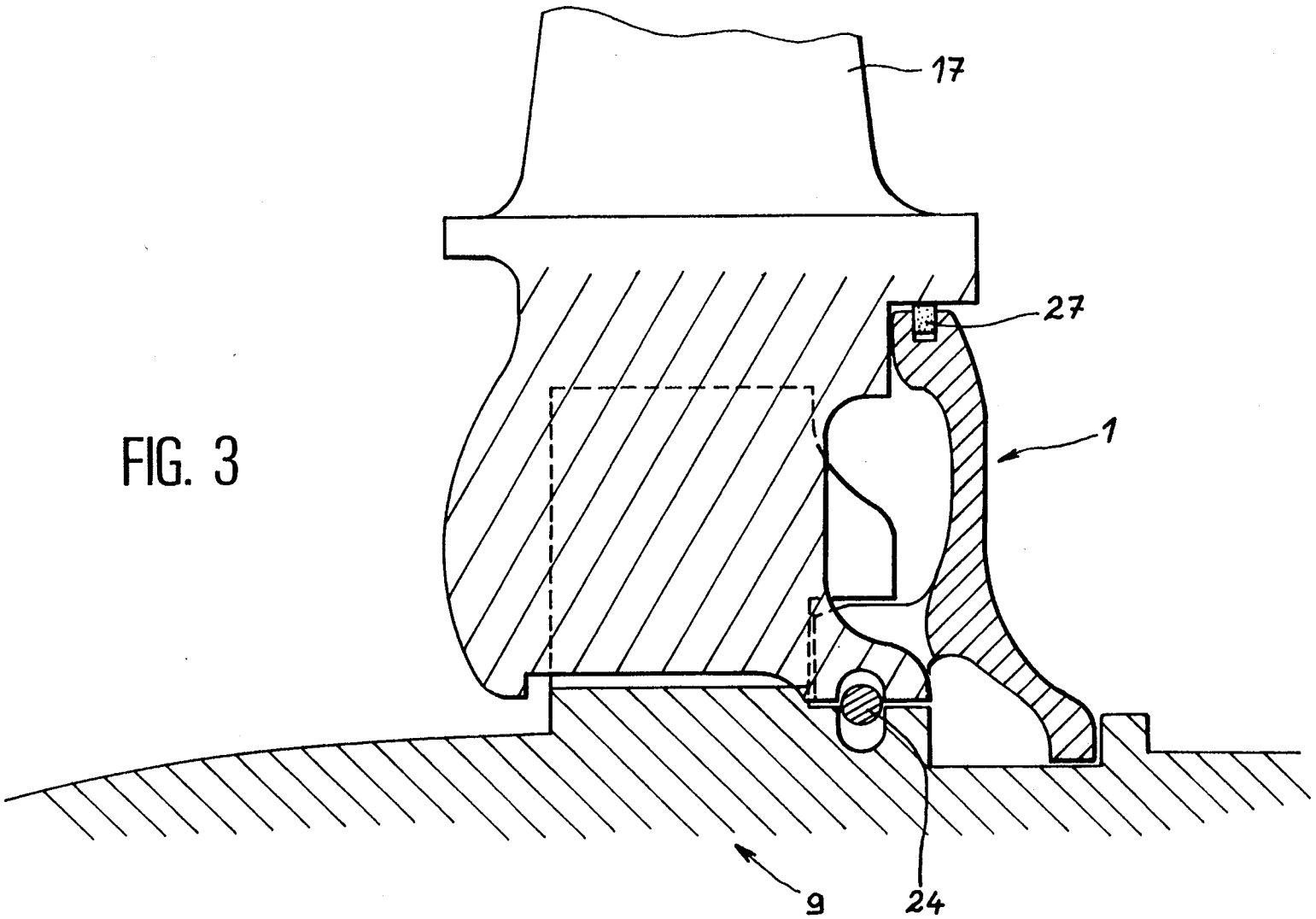
FIG. 3 shows in detail the system in an assembled state.
Figure 6:
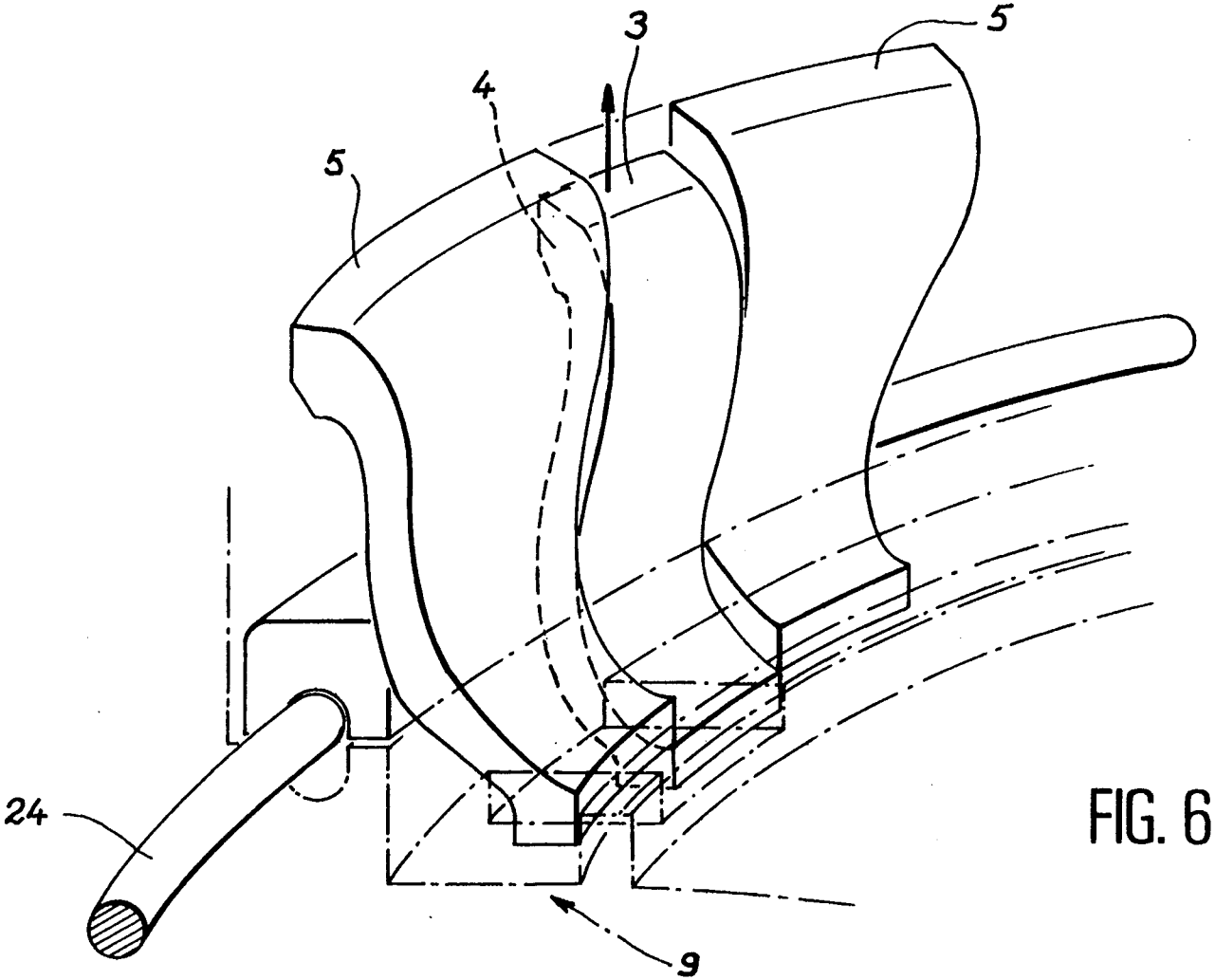

The flange 1 (FIGS. 1 to 3) is a ring divided into sectors 2 (FIG. 4) whose angular extension is uniform and corresponds to a vane implantation pitch, except for a short sector 3 whose flanks 4 are parallel, the short sectors being correlatively framed by two elongated sectors 5 (FIG. 6) whose angular extension is slightly larger than the ordinary sectors 2. The sectors 2, 3 and 5 all have the same section taken in a longitudinal plane formed (FIG. 2) of one internal lip 6 extending obliquely in a radial and longitudinal direction an outer lip 7, and a tab 8 which extends in a longitudinal direction towards the vanes opposite the internal lip 6, but whilst the lips 6 and 7 have a total angular extension which embraces the entire circumference of the flange 1, the tabs 8 of the various sectors 2, 3 and 5 form a discontinuous network and are separated from one another.

The rotor disk is denoted by the reference 9. It includes a circular recess 10 with the shape of a groove or throat and which in particular comprises a circular bottom bearing surface 11 and a stop bearing surface 12 distanced from the vanes. Surfaces having a shape identical to the internal lip 6 abut against these bearing surfaces and provide one part of the sealing function. The disk 9 further includes (FIG. 4) axial broachings 13 between which bosses 14 extend, a claw coupling projection 15 being established on each boss, as well as a disk throat 23 (FIG. 2) adjacent to the circular recess 10 parallel to it and situated between it and the bosses 14. The disk throat 23 opens outwardly.

Figure 4:
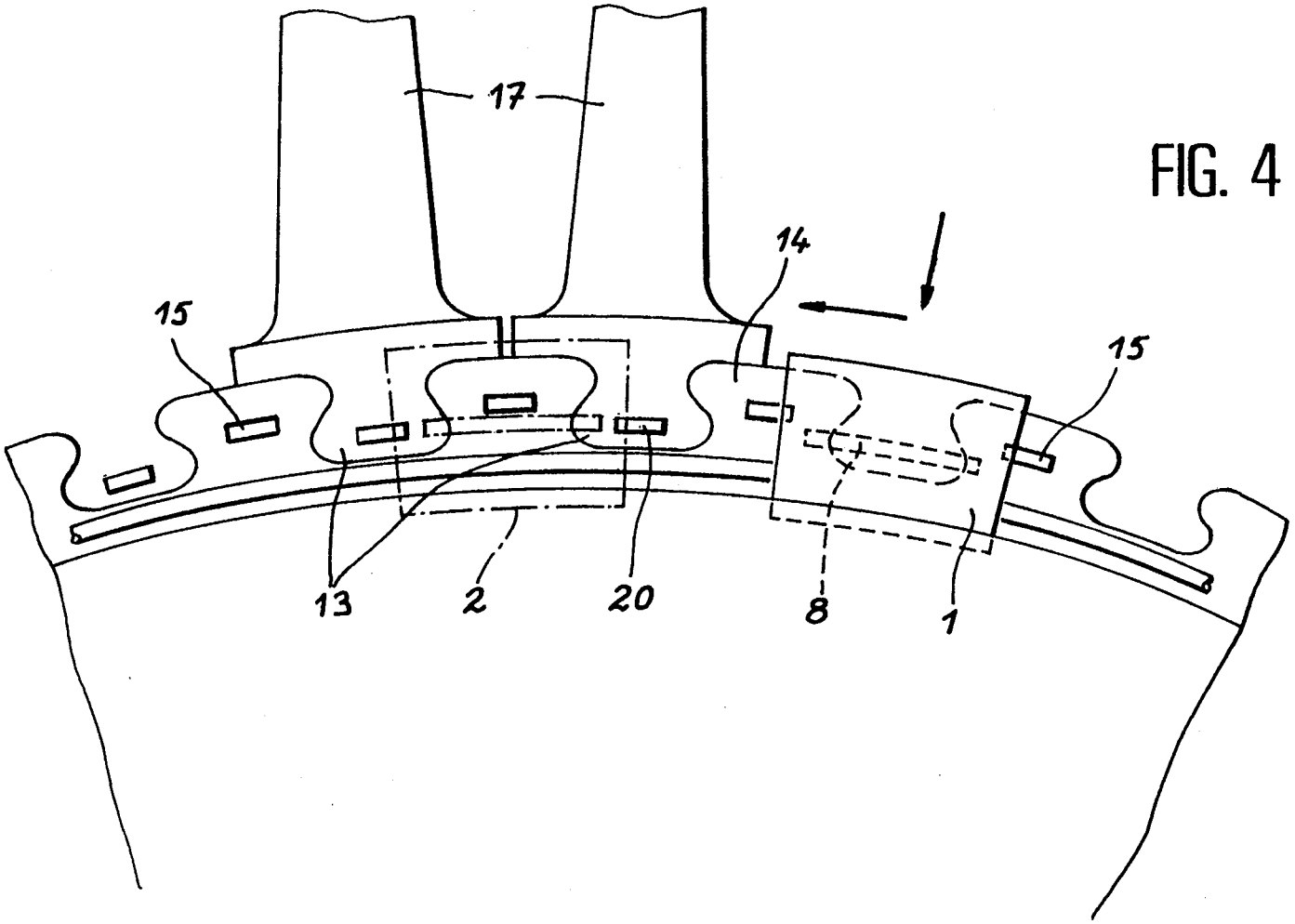
FIG. 4 shows a view in an axial direction of the system during assembling.

The vanes are denoted by the reference 16 and composed of a blade 17 which constitutes the effective part of the vane 16, and a foot 18 engaged in a corresponding broaching 13. The feet 18 comprise an arc of a circle projection 19 and forming a pair of bearing surfaces at a right angle intended to complete the sealing function by undergoing the pressure of surfaces having the same disposition of the outer lip 7. The projections 19 are in fact situated on external portions of the feet 18 adjacent to the blades 17; these portions are not engaged on the broachings 13 and surround the bosses 14; they are contiguous and all extend over the entire circumference or almost do (FIG. 4).

The vanes 16 also include tabs 20 which extend over arc portions of the feet 18 projecting from the bottom of the broachings 13 towards the sectors 2, 3 and 5. When the elements of the system are mounted, the tabs 8 and 20 overlap each other; throat portions, respectively 21 and 22, which they bear, extend so as to form a single throat (which moreover may be discontinuous along the actual angular extension of the tabs 8 and 20) and which is also open towards the inside and on the disk throat 23. An elastic circular joint 24 is housed in the throats 21 and 22 and preferably also in one portion of the disk throat 23.

The outer surface 25 of the tabs 8 of the flange 1 touches the internal surface 26 of the claw coupling projections 15 and prevents any radial movement of the sectors 2, 3 and 5, and the centrifugal forces created by the rotation of the disk 9 in operation then provokes a movement of rotation around the claw coupling projections 15 of the sectors 2, 3 and 5 whose lips 6 and 7 come to touch the sealing bearing surfaces of the circular recess 10 and steps 19. A lip gasket 27 (FIG. 3) may be placed on the outer lip 7 so as to complete imperviousness by pressing on the bearing surface orientated towards the inside of the step 19. The joint 24 locks both the vanes 16 and the sectors of the flange 1 in an axial direction.

The mounting of the system consists first of all of placing the sectors 2 and 5 of the flange 1 and the vanes 16 and more specifically in this embodiment, where there are as many vanes 16 as the sectors 2, 3 and 5, of alternating an insertion of a vane 16 in its broaching 13 and an introduction of a sector 2 or 5 effected via a radial movement so as to place it on the disk 9 and place the extremity of its internal lip 6 in the circular recess 10 but near its definitive position so that its tab 8 passes in front of a broaching 13, still empty, between consecutive claw coupling projections 15, and then via an angular movement so as to slide the tab 8 under the claw coupling projection 15 which shall retain it and until the tab 8 arrives against the tab 20 of the vane 16 which has just been placed or merely close to it. The movement is continued until the sector 2 or 5 which it undergoes touches the adjacent sector already installed.

This complex movement is shown on FIG. 4 and carried out along the arrows. No deformation of the sectors 2 and 5 is required. The joint 24 is partially driven back into the disk throat 23 when the tab 20 arrives at its final position, is then rectified via its elasticity and re-enters the throat 22.

Figure 5:
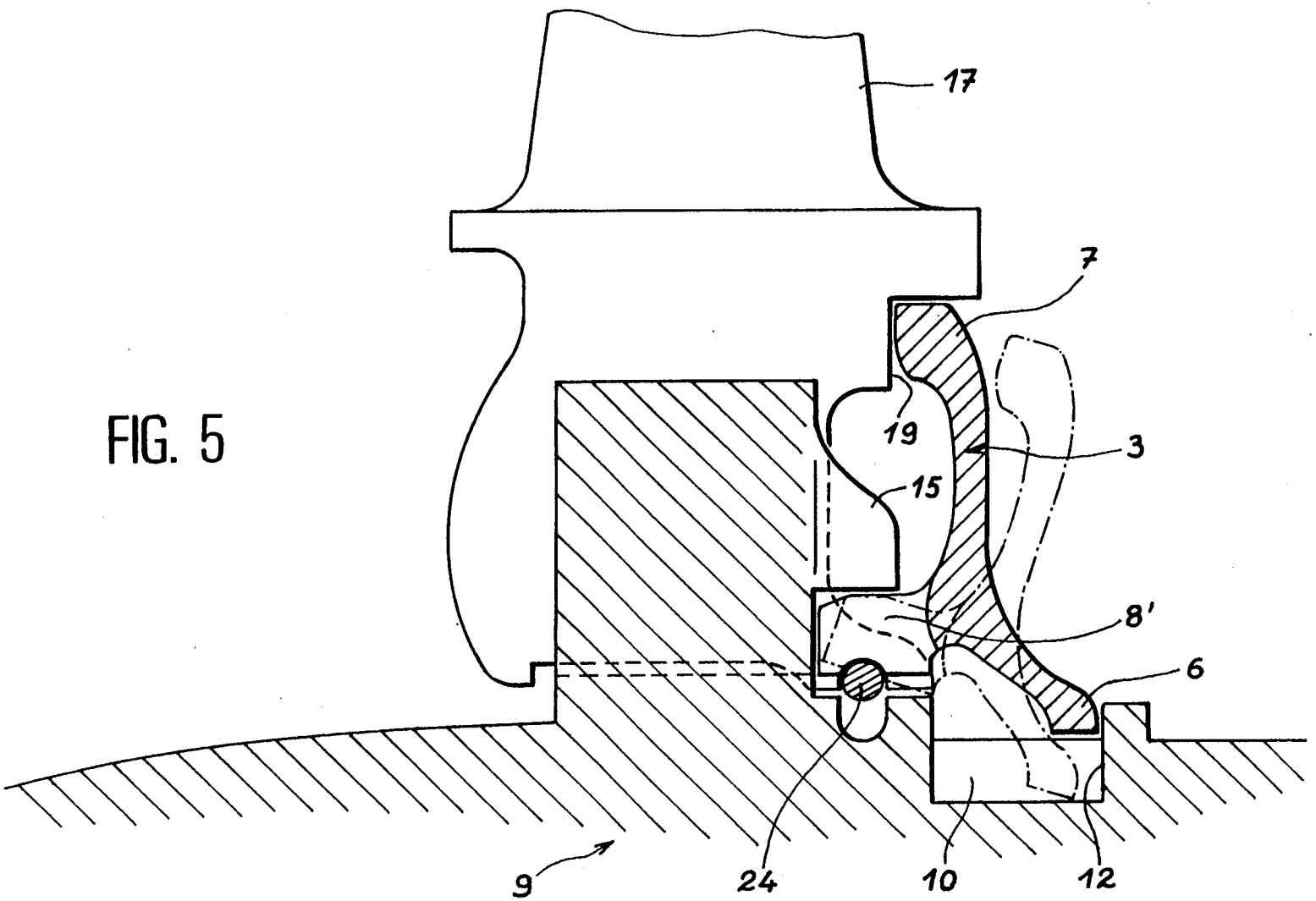
FIGS. 5 and 6 show a perspective view in longitudinal section of one particular stage of assembling.

When the final vane 16 is placed, it merely remains to insert the short sector 3. The method is rather particular and involves movements made carefully in accurately adjusted pieces shown on FIGS. 5 and 6. The short sector 3 is introduced between the elongated sectors 5 via an oblique movement which makes it arrive at the position of FIG. 6 and shown by the dot-and-dash lines on FIG. 5 so that the internal lip 6 is engaged deeply inside the circular recess 10 (which is significantly deeper at this location) and the tab 8' (finer than the other tabs 8 owing to a machining of its internal surface which causes the throat 21 to partly disappear) starts to clear an opening between the associated claw coupling projection 15 and the joint 24. A straightening tilting is then made to the short sector 3 so that its internal lip 6 is lifted from the bottom of the circular recess 10 and abuts against the bearing surface 12, its outer lip 7 enters the associated projection 19 and its tab 8' slides between the claw coupling projection 15 and the joint 24. In its definitive position, the short sector 3 extends into the others. It closes the circumference of the flange 1 and, by virtue of its particular shape, resembles a key stone. It is clearly less subject to the assembly than the other sectors 2 and 5 owing to the fineness of the tab 8' which remains distanced from the surface on which the disk throat 23 is hollowed out and the lack of contact of the internal lip 6 on the bearing surface 11, but it is sufficiently well supported to remain in place and does not compromise imperviousness.

The joint 24 is a particuarly simple effective device of the mobile elements of the system in an axial direction and the assembling of the flange 1 is relatively short and simple.

What is claimed is:

1. A system for retaining and sealing vanes having vane feet engaged in axial broachings of a rotor disk, the system comprising:

a circular sealing flange mounted on the disk and in front of one face of the broachings so as to cover the vane feet, said flange including one internal sealing lip housed in a circular recess of the disk and one outer sealing lip applied to a bearing surface of the vane feet;

wherein:

said flange and said vane feet each comprise imbricated tabs such that when the tabs are adjacently positioned, the tabs define a first throat which is radially open inwardly with respect to the disk;

the disk comprises a second throat which is radially open outwardly with respect to the disk and is positioned radially below the first throat so as to face the first throat;

an elastic joint is positioned at least in the first throat while being able to be driven fully into the second throat; and the flange is divided into sectors of a circle, each of the sectors being provided with a respective tab which touches a projection on the disk via its radially external face, one of said sectors being adapted to be installed via a radial and longitudinal movement between other sectors, wherein the tabs of the sectors have an angular extension smaller than spaces between the projections of the disk.

2. A retaining and sealing system according to claim 1, wherein the number of sectors is equal to the number of vanes, the tabs of the sectors alternating with the tabs of the vane feet.

3. A retaining and sealing system according to claim 1, wherein the flange includes a gasket on the outer sealing lip and touching the bearing surface of the vane feet.

4. A retaining and sealing system according to claim 1, wherein said one sector has flanks for joining to parallel adjacent sectors.

5. A retaining and sealing system according to claim 1, wherein the tab of said one sector is smaller than the other tabs so as to define a space between the tab and a surface of the disk, and the circular recess is deeper at the location of said one sector.

* * * * *